US006877599B2

(12) United States Patent
Pai

(10) Patent No.: US 6,877,599 B2
(45) Date of Patent: Apr. 12, 2005

(54) PAPER CURRENCY RECEIVING APPARATUS WITH FRAUD PREVENTION

(75) Inventor: John Pai, Tainan (TW)

(73) Assignee: Chain Link Electronic Co., Ltd., Tainan (TW)

( * ) Notice: Subject to any disclaimer, the term of this patent is extended or adjusted under 35 U.S.C. 154(b) by 139 days.

(21) Appl. No.: 10/357,187

(22) Filed: Feb. 3, 2003

(65) Prior Publication Data

US 2004/0149537 A1 Aug. 5, 2004

(51) Int. Cl.[7] ..... G07D 7/00
(52) U.S. Cl. ..... 194/203; 194/350
(58) Field of Search ..... 194/203, 202, 194/350, 351, 302

(56) References Cited

U.S. PATENT DOCUMENTS 4,348,656 A * 9/1982 Gorgone et al. ..... 382/135
5,259,490 A * 11/1993 Gardellini ..... 194/203
5,325,952 A * 7/1994 McGinley et al. ..... 194/203
5,454,462 A 10/1995 Chang ..... 194/203
5,462,150 A 10/1995 Chang ..... 194/206
5,485,907 A 1/1996 Chang ..... 194/203
6,668,998 B1 * 12/2003 Mosteller et al. ..... 194/203

* cited by examiner

*Primary Examiner*—Donald P. Walsh
*Assistant Examiner*—Mark J. Beauchaine
(74) *Attorney, Agent, or Firm*—Alan D. Kamrath; Nikolai & Mersereau, P.A.

(57) ABSTRACT

A paper currency receiving apparatus includes a body with a bill-receiving opening in a front end thereof, a detecting device mounted in the body and defining a bill passage through which a bill inserted into the bill-receiving opening passes, and a bill-collecting box for receiving the bill. The genuineness of the bill is discriminated by the detecting device. In a case that a fraud operation is attempted by bonding an end of a string to a side of the bill and inserting the bill into the bill-receiving opening, the string is severed by one of a plurality of cutting edges on the detecting device.

10 Claims, 13 Drawing Sheets

PAPER CURRENCY RECEIVING APPARATUS WITH FRAUD PREVENTION

BACKGROUND OF THE INVENTION

1. Field of the Invention

The present invention relates to a paper currency receiving apparatus for receiving paper currency. In particular, the present invention relates to a paper currency receiving apparatus for preventing fraud operation.

2. Description of the Related Art

A paper currency receiving apparatus is widely used in e.g., vending machines and automated-teller machines. When a bill (or note) is inserted into a slot of the paper currency receiving apparatus, the bill is carried into an interior of the paper currency receiving apparatus and then discriminated by a detecting device for identifying whether the bill is genuine. However, fraud operation can be proceeded by bonding an end of a string to a side of the bill and pulling the bill out of the paper currency receiving apparatus after the bill has passed the detecting device. Thus, a fraud may purchase commodities and proceed with other deals. In addition to the loss of money, the paper currency receiving apparatus is apt to be damaged through the fraud operation.

SUMMARY OF THE INVENTION

An object of the present invention is to provide a paper currency receiving apparatus that may prevent fraud operation.

A paper currency receiving apparatus in accordance with the present invention includes a body having a bill-receiving opening in a front end thereof, and a detecting device mounted in the body and defining a bill passage through which a bill inserted into the bill-receiving opening passes. The detecting device discriminates genuineness of the bill. The bill inserted into the bill-receiving opening is fed into an interior of the body. In a case that a string is bonded to a side of the bill for attempting a fraud operation, the string is severed by a cutting edge on the detecting device.

In a preferred embodiment of the invention, a paper currency receiving apparatus comprises:

a body having a bill-receiving opening in a front end thereof;

a first detecting device mounted in the body and including an upper detection box and a lower detection box, the upper detection box and the lower detection box together defining a bill passage through which a bill inserted into the bill-receiving opening passes, the first detecting device discriminating genuineness of the bill, the lower detection box including a top surface having an end adjacent to the bill-receiving opening, a toothed portion being formed on the end of the top surface and projecting upward, with a cutting edge being defined between two adjacent teeth of the toothed portion of the lower detection box;

a second detecting device mounted below the lower detection box, the second detection device including a detection block pivotally mounted thereto, the detection block including a toothed portion, with a cutting edge being defined between two adjacent teeth of the toothed portion of the detection block; and means for feeding the bill inserted into the bill-receiving opening to the first detection device and the second detection device;

wherein when a fraud operation is attempted by bonding an end of a string to a side of a bill and inserting the bill through the bill-receiving opening, the string falls into and is thus severed by one of the cutting edges of the first detection device when the string is pulled before the bill is completely passed through the second detection device or when the bill is moving toward the second detection device; and wherein when the bill is passed through the second detecting device without being severed by the cutting edges of the first detecting device, the string falls into one of the cutting edges of the first detecting device and one of the cutting edges of the second detecting device such that the string is severed when the string is pulled.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
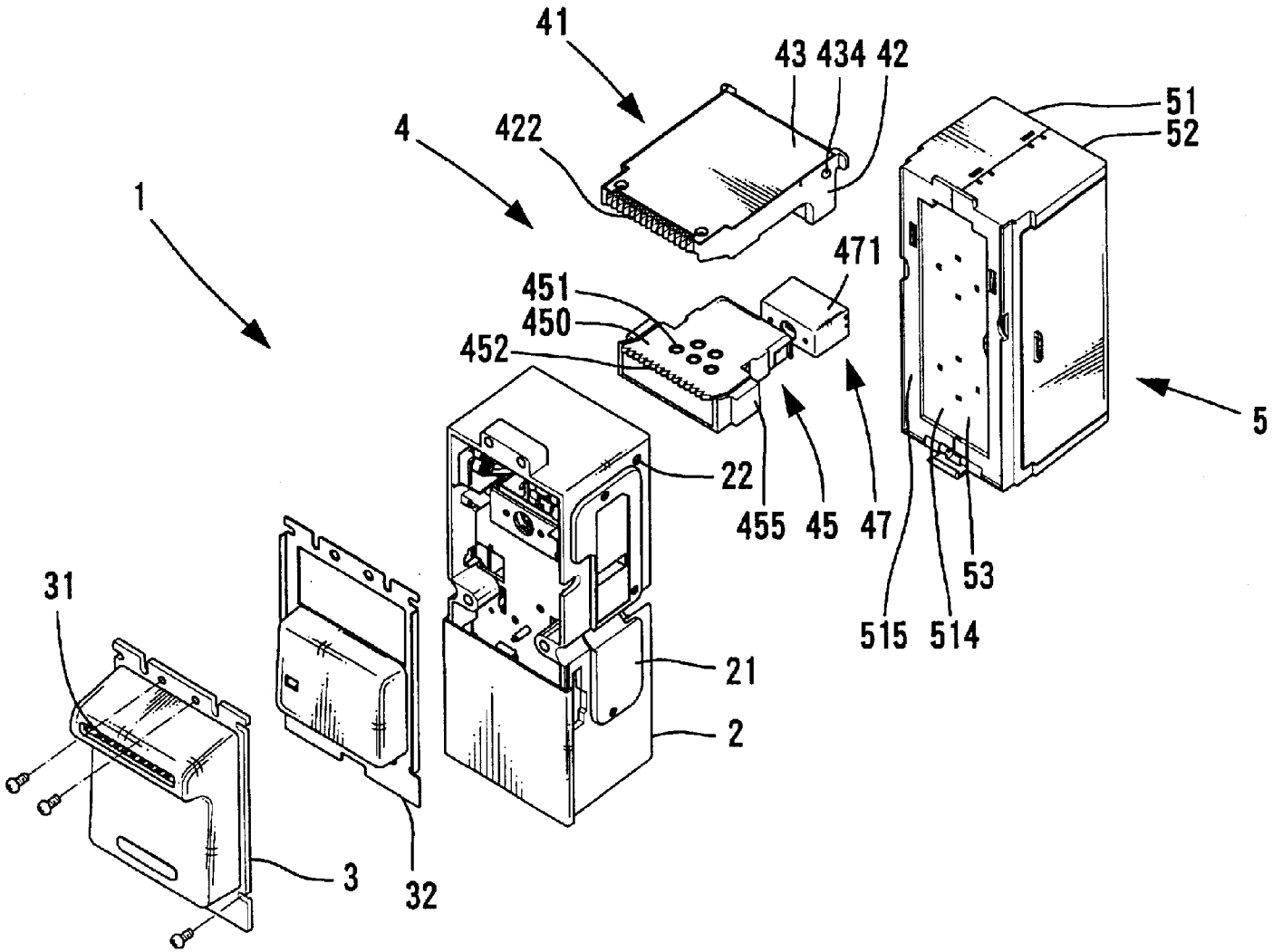
FIG. 1 is a perspective view, partly exploded, of a paper currency receiving apparatus in accordance with the present invention.
Figure 6:
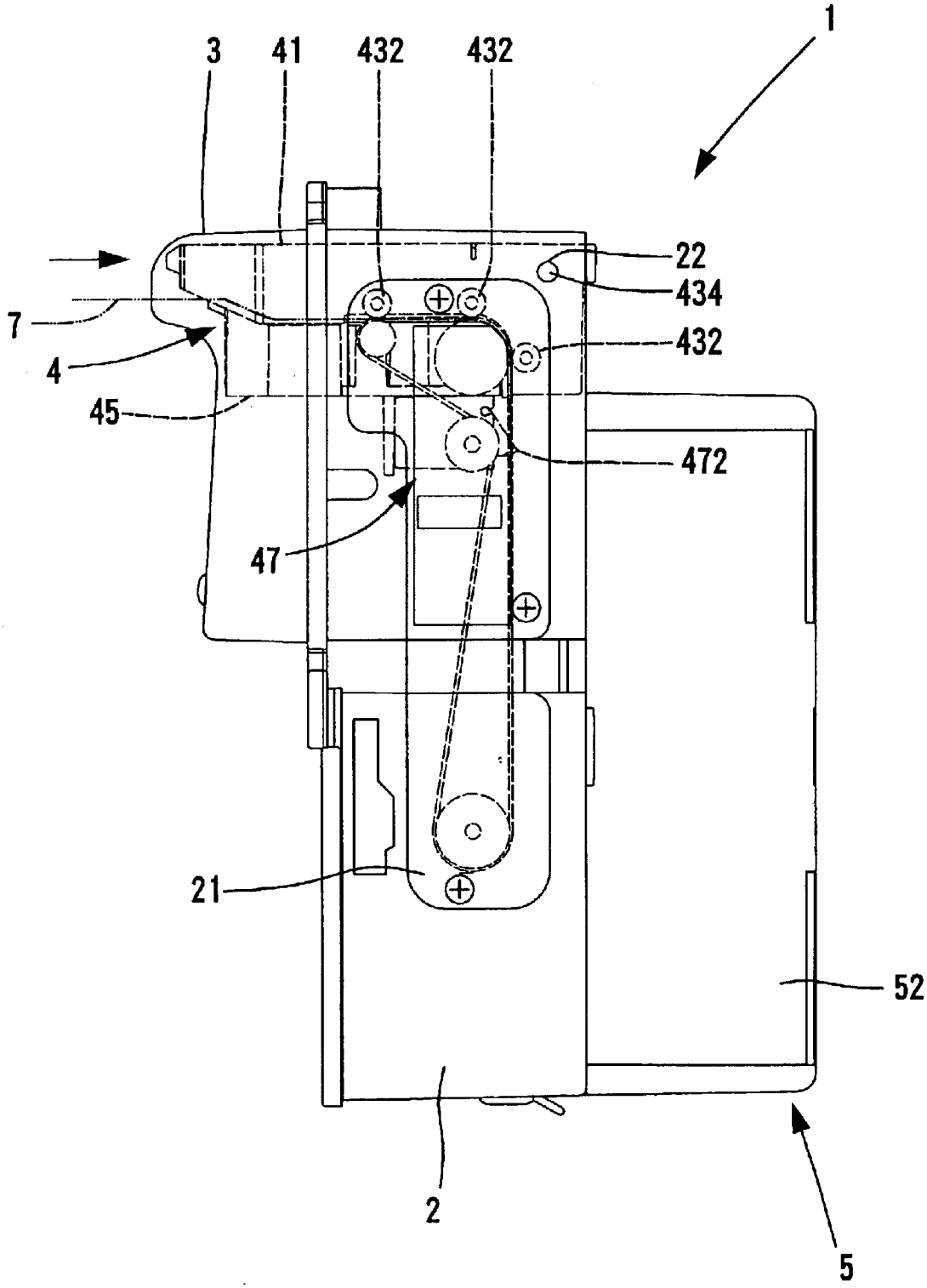
FIG. 6 is a side view of the paper currency receiving apparatus in accordance with the present invention.
Figure 7:
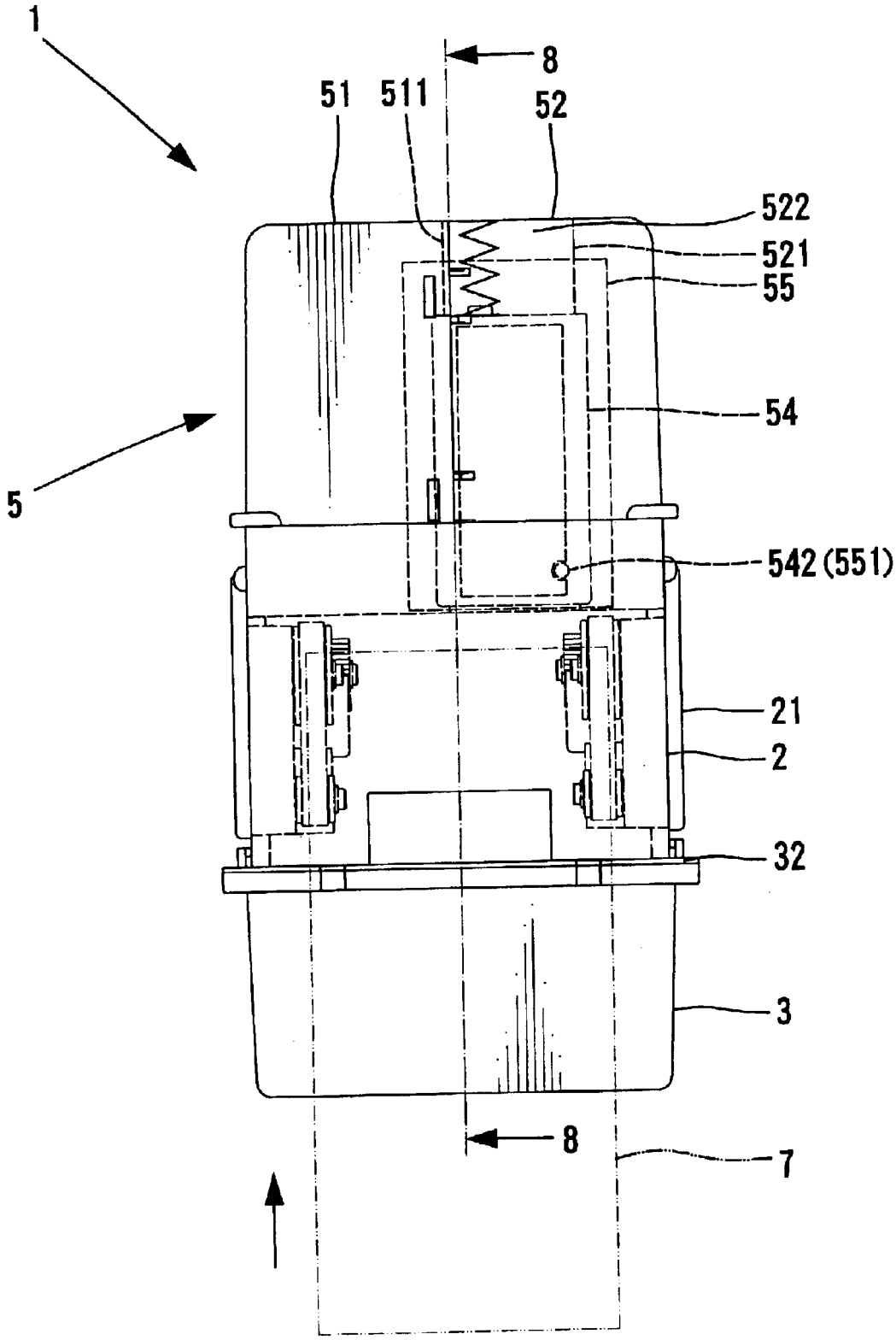
FIG. 7 is a top view of the paper currency receiving apparatus in accordance with the present invention.

Referring to FIG. 1, a paper currency receiving apparatus in accordance with the present invention is designated by "1" and generally comprises a body 2 and two wheel assembly modules 21 respectively, detachably attached to two opposed lateral sides of the body 2. A front cover 3 is mounted to a front end of the body 2 and includes a bill-receiving opening 31 communicated with the interior of the body 2. Referring to FIGS. 1, 6, and 7, a bill 7 may be inserted into the body 2 via the bill-receiving opening 31. A bill-collecting box 5 is mounted to a rear of the body 2 for receiving the bill 7 fed by the wheel assembly modules 21 into the interior of the body 2. A mounting hole 22 is defined in each lateral side of the body 2, which will be described later. A protective plate 32 may be mounted between the front cover 3 and the body 2.

Figure 8:
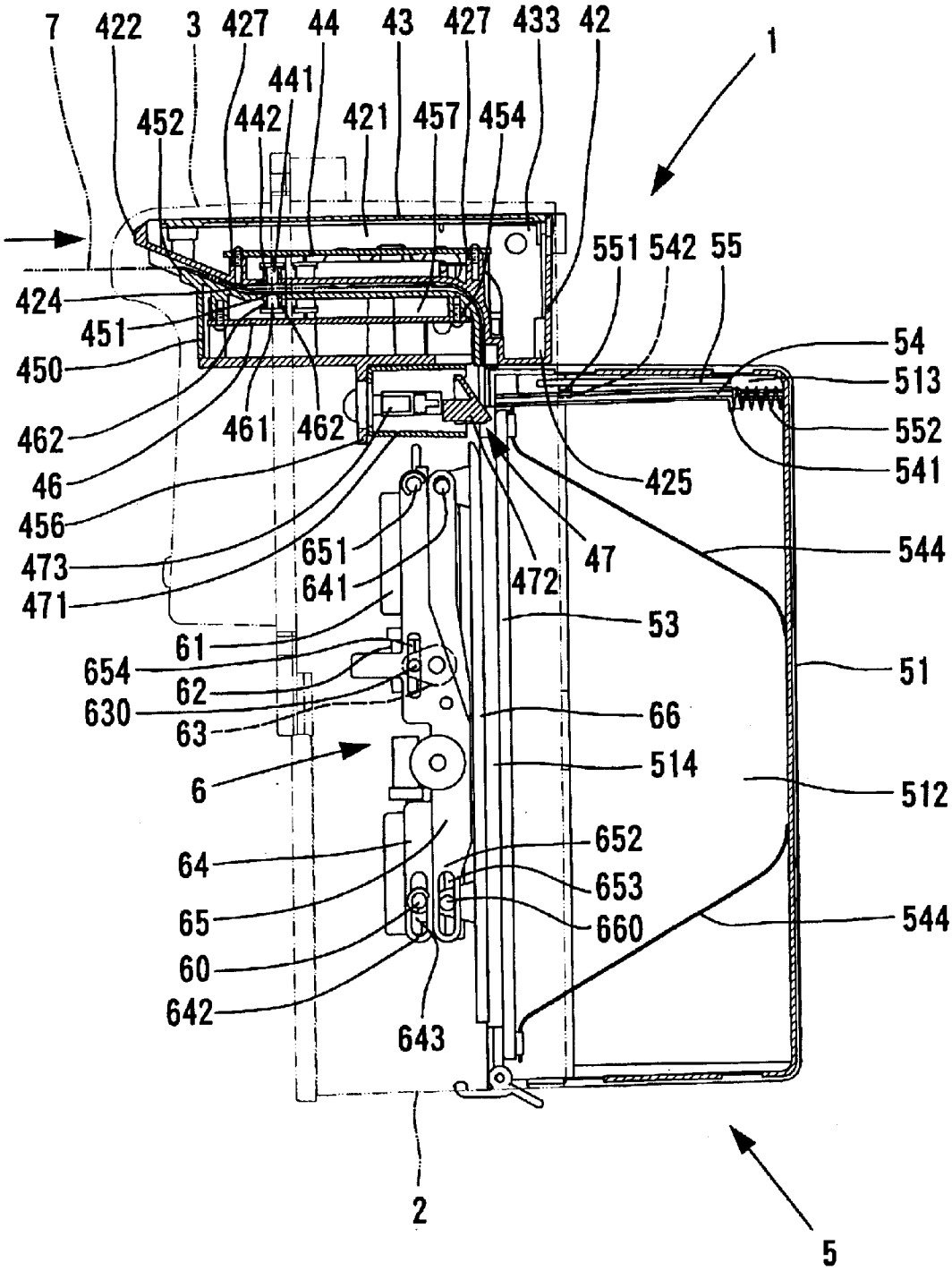
FIG. 8 is a sectional view taken along plane 8—8 in FIG. 7.

Referring to FIGS. 1 and 8, the paper currency receiving apparatus 1 further includes a first detection device 4 and a second detection device 47 mounted between the first detection device 4 and the bill-collecting box 5. The first detection device 4 includes an upper detection box 41 and a lower detection box 45 having an underside to which the second detection device 47 is mounted. The upper detection box 41 and the lower detection box 45 together define a bill passage (not labeled) through which the bill 7 passes.

Figure 2:
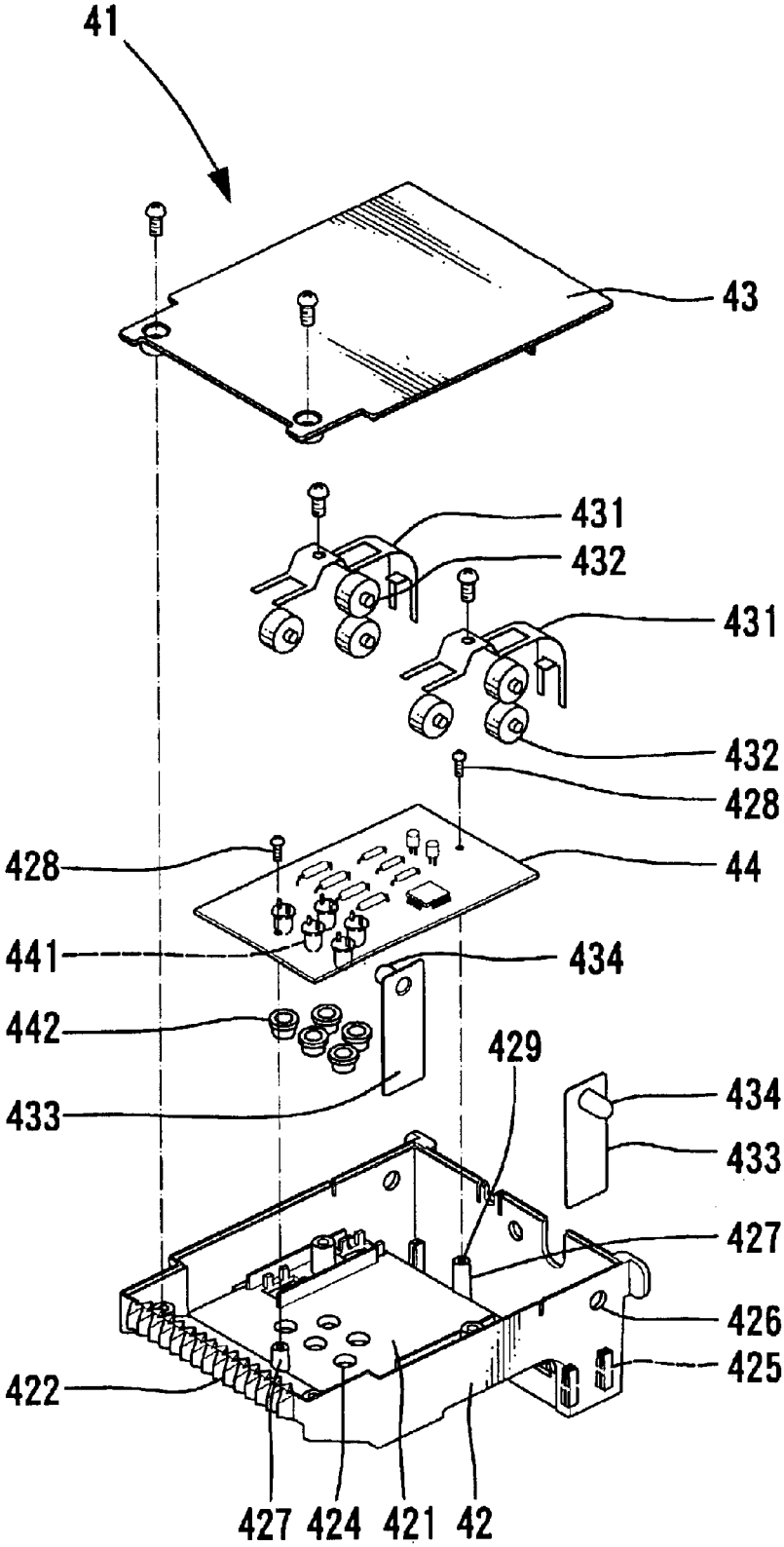
FIG. 2 is an exploded perspective view of an upper detection box of a first detecting device of the paper currency receiving apparatus in accordance with the present invention.

Referring to FIGS. 2, 6, and 8, the upper detection box 41 includes a substantially L-shaped casing 42 defining a compartment 421 therein and an upper lid or cover 43 for closing the compartment 421. The casing 42 includes an engaging portion 422 that is securely connected to the front cover 3. The casing 42 further includes a plurality of detection holes 424 in a bottom wall thereof and a plurality of positioning pegs 427 each having a screw hole 429. Further, each lateral side of the casing 42 includes an engaging portion 425 for securely receiving a lower end of an engaging plate 433 that has a protrusion 434 extending through a hole 426 in an associated lateral side of the casing 42.

A circuit board 44 is fixed to the casing 42 by means of extending screws 428 through holes (not labeled) in the circuit board 44 into the screw holes 429 of the positioning pegs 427. A plurality of detecting elements 441 are mounted on the circuit board 44, with a protective cover 442 mounted to each detecting element 441 and with each detecting element 441 extending into an associated detection hole 424. Each wheel assembly module 21 includes a plurality of rollers or wheels 432, with a pressing plate 431 being provided for each wheel assembly module 21 for restraining positions of the rollers 432.

Figure 3:
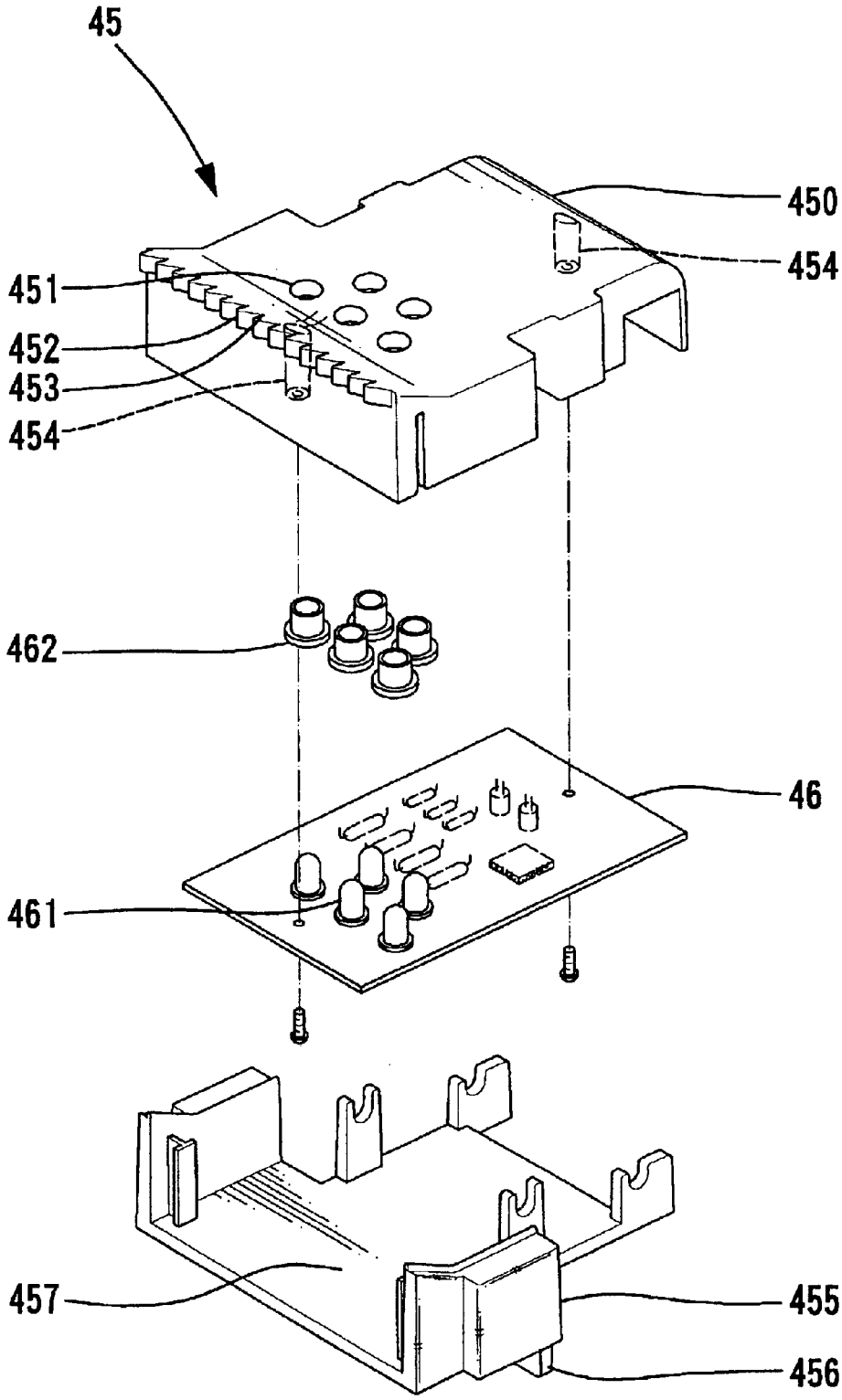
FIG. 3 is an exploded perspective view of a lower detection box of the first detecting device of the paper currency receiving apparatus in accordance with the present invention.

Referring to FIGS. 3 and 8, the lower detection box 45 includes an upper casing 450 and a lower casing 455. The bill passage is defined between the bottom wall of the casing 42 of the upper detection box 41 and a top surface 458 of the upper casing 450 of the lower detection box 45. A toothed portion 452 is formed on an end of the top surface 458 of the upper body 450 and projects upward from the end of the top surface 458 that is adjacent to the bill-receiving opening 31 of the front cover 3. A substantially V-shaped cutting edge 453 is formed between two adjacent teeth of the toothed portion 452. The upper casing 450 further includes a plurality of detection holes 451. Securely mounted in a compartment 457 between the upper casing 450 and the lower casing 455 is a circuit board 46 that is mounted to positioning pegs 454 provided on the upper casing 450 and has a plurality of detecting elements 461 mounted thereon. A protective cover 462 is mounted to each detecting element 461 that is extended into an associated detection hole 451. A mounting plate 456 is provided on an underside of the lower casing 455 for attachment of the second detection device 47.

Each protective cover 462, 442 is tightly mounted between an associated detecting element 461, 441 and a peripheral wall defining an associated detection hole 451, 424. Thus, the protective covers 462 and 442 may protect the detecting elements 461 and 441 from being damaged by moisture and alien objects and preventing water from entering the upper detection box 41 and the lower detection box 45.

Referring to FIGS. 1 and 6, after the upper detection box 41 and the lower detection box 45 of the first detection device 4 are engaged together, the protrusion 434 on each engaging plate 433 is extended into an associated mounting hole 22 of the body 2, thereby fixing the upper detection device 4 in place. When a bill 7 is inserted into the body 2 through the bill-receiving opening 31 of the front cover 3, the detecting elements 441 and 461 respectively on the upper detection box 41 and the lower detection box 45 determines whether the bill 7 is genuine. If yes, the bill 7 is passed to the second detection device 47. If not, the bill 7 is rejected out of the body 2 through the bill-receiving opening 31 of the front cover 3.

Figure 5:
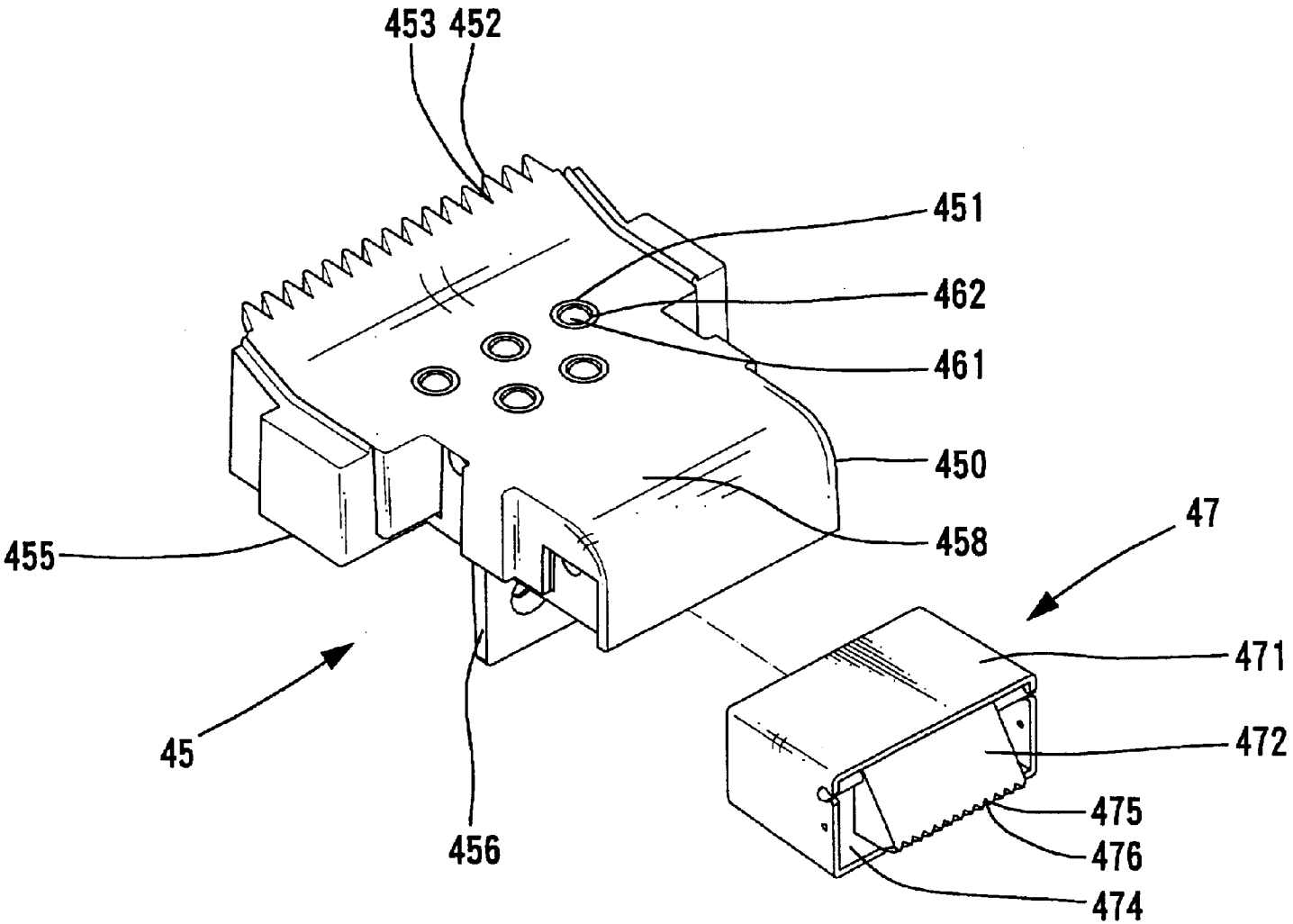
FIG. 5 is an exploded perspective view of the lower detection box and a detection box of a second detecting device of the paper currency receiving apparatus in accordance with the present invention.

Referring to FIGS. 1, 5, and 8, the second detection device 47 includes a detection box 471 and a detection block 472 pivotally mounted to an end of the detection box 471. The detection block 472 includes a toothed portion 475 on an end thereof, with a substantially V-shaped cutting edge 476 being defined between each two adjacent teeth of the toothed portion 475. A sensor 473 (FIG. 8) is mounted in a compartment 474 defined in the detection box 471. When the bill 7 is passing through the second detection device 47, the bill 7 presses against the detection block 472 and thus causes swaying of the sensor 473. Thus, passage of a bill 7 through the second detection device 47 is detected through the swaying movement of the sensor 473.

Figure 4:
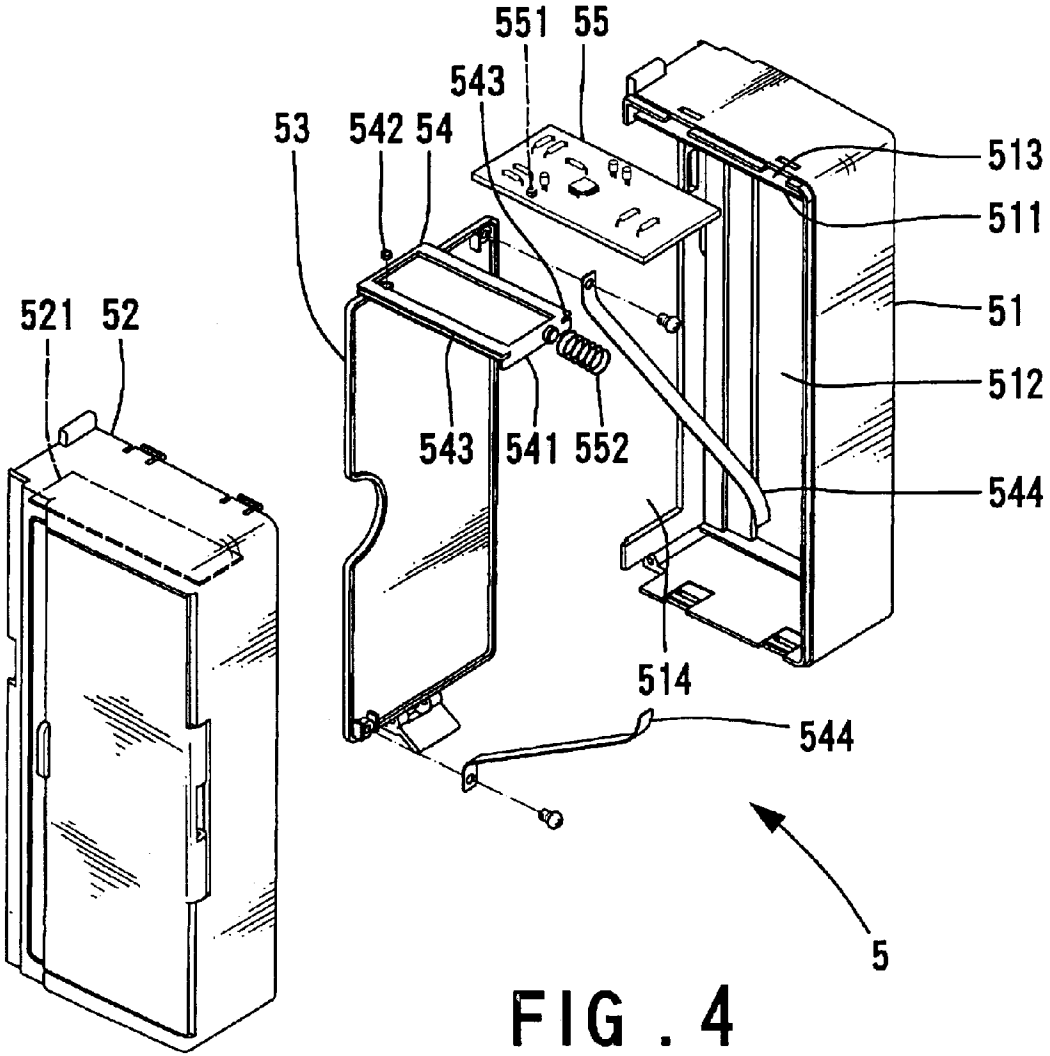
FIG. 4 is an exploded perspective view of a bill-collecting box of the paper currency receiving apparatus in accordance with the present invention.
Figure 9:
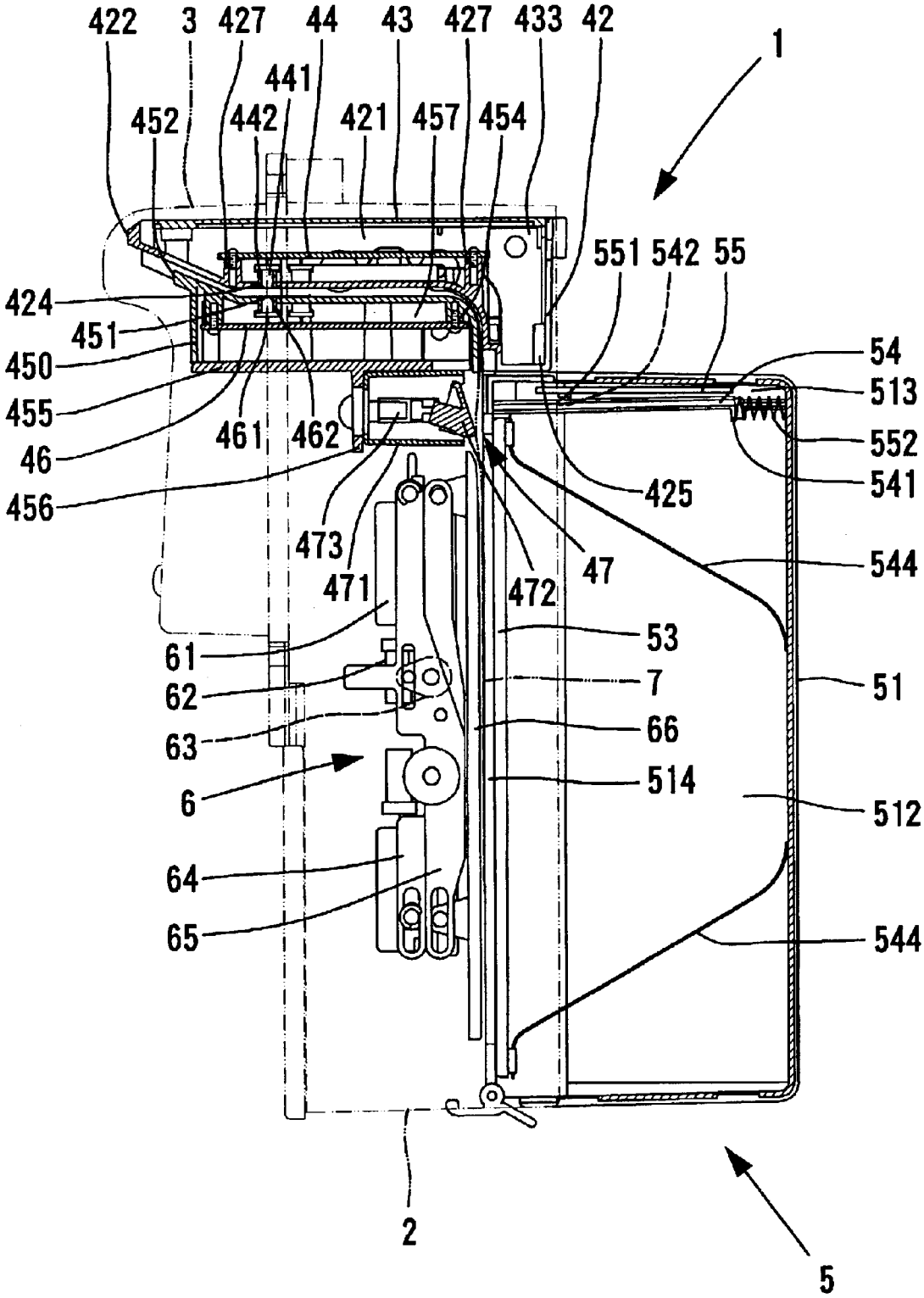
FIG. 9 is a view similar to FIG. 8, wherein the bill is in the second detection device.

Referring to FIGS. 4 and 9, the bill-collecting box 5 includes two casing halves 51 and 52 and a pressing plate 53 mounted in a compartment defined by the casing halves 51 and 52. The pressing plate 53 includes two resilient members 544 each having a first end fixed to a corner of the pressing plate 53 and a second end in contact with a rear wall of the bill-collecting box 5. Preferably, the first ends of the resilient members 544 are fixed to two diagonally disposed corners of the pressing plate 53. The casing halves 51 and 52 together define a bill-entrance opening 514 delimited by a peripheral edge 515. The bill-entrance opening 514 has an area smaller than that of a bill 7. The pressing plate 53 has an area greater than that of the bill-entrance opening 514. Thus, the pressing plate 53 presses against the peripheral edge 515 delimiting the bill-entrance opening 514 under the action of the resilient members 544.

Referring to FIG. 8, a power device 6 is mounted in the body 2 and includes a motor 61 and a gear train 62 driven by the motor 61. Two cams 63 are connected to and thus drivable by the gear train 62. A first push arm 64 and a second push arm 65 are provided on each of two sides of the motor 61 and extend across each other. In particular, each first push arm 64 has a first end 641 fixed to a push plate 66 facing the pressing plate 53 and a second end 642 having a guide slot 643. A peg 60 is provided on each side of the motor 61 and is slidably received in the guide slot 643 of a respective first push arm 64. Each second push arm 65 has a first end 651 fixed to a respective side of the motor 61 and a second end 652 having a first guide slot 653. The push plate 66 has a peg 660 that is slidably received in the first guide slot 653 of a respective second push arm 65. Further, each cam 63 has a peg 630 formed thereon, the peg 630 being slidably received in a second guide slot 654 in an intermediate portion of a respective second push arm 65.

Figure 10:
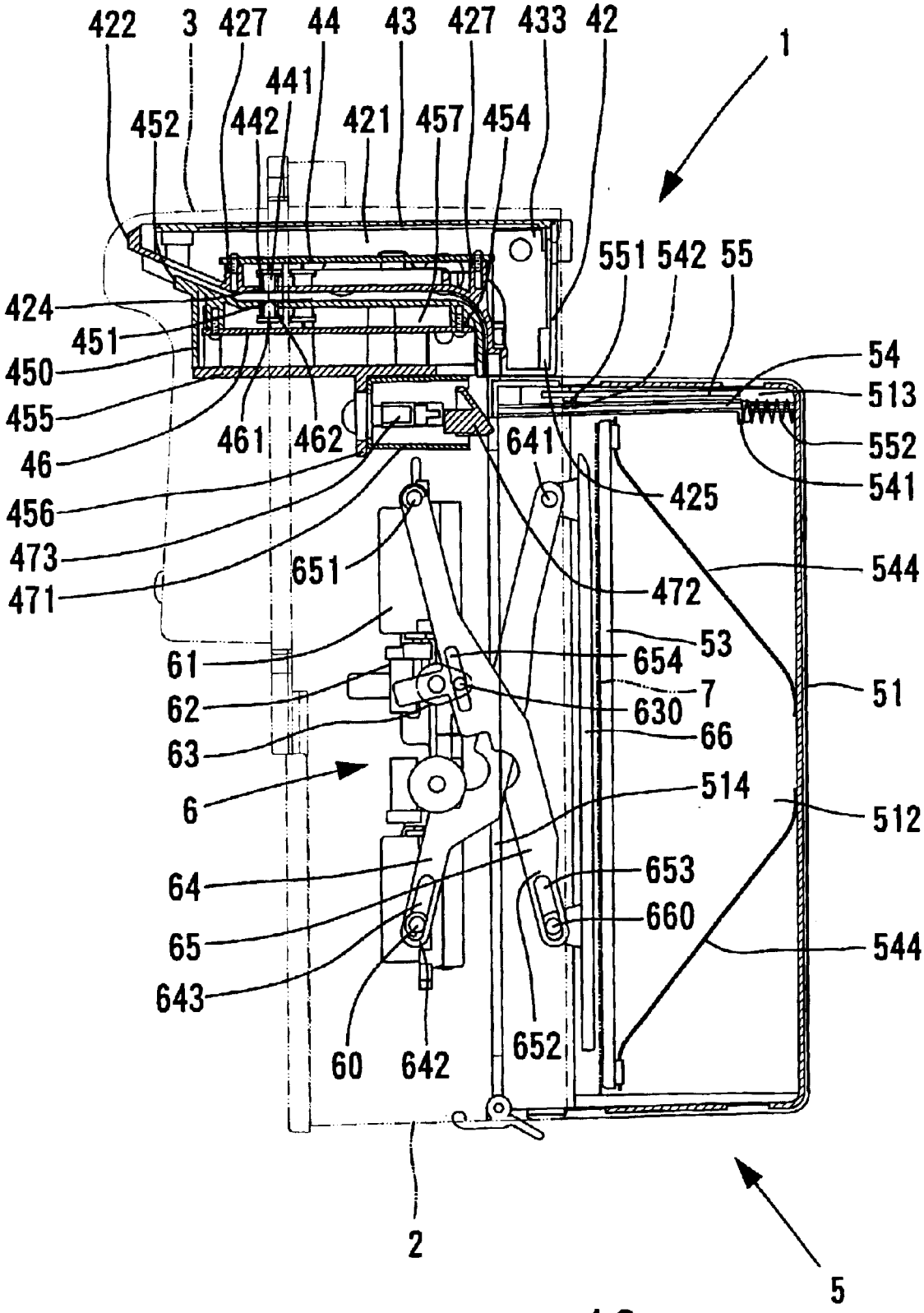
FIG. 10 is a view similar to FIG. 8, wherein the bill is pushed into the bill-collecting box.

Referring to FIGS. 8 and 10, when a bill 7 is passed through the second detection device 47, the detection block 472 sways back to its initial position and the motor 61 is activated to drive the gear train 62. Each cam 63 is turned to move the push arms 64 and 65 toward the pressing plate 53. The push plate 66 is thus moved toward the pressing plate 53 and forcibly pressing the bill 7 into the bill-collection box 5 via the bill-entrance opening 514 that is smaller than the bill 7, as shown in FIG. 10. Thereafter, the push plate 66 and the push arms 64 and 65 return to their initial position during further rotation of the respective cam 63, and the pressing plate 53 is moved by the resilient members 544 to press against the peripheral edge 515 (FIG. 1) that delimits the bill-entrance opening 514, with the bill 7 being sandwiched between the peripheral edge 515 and the pressing plate 53.

Referring to FIGS. 4, 7, and 8, a partitioning member 511, 521 is provided in each casing half 51, 52, thereby separating the bill-collecting box 5 into a first compartment 512 (the lower one in FIG. 8) and a second compartment 513 (the upper one in FIG. 8) that are communicated with each other via a communication opening 522 therebetween. The bills 7 are accumulated in the first compartment 512, and a circuit board 55 is mounted in the second compartment 513 and has a magnetic element 551 that faces the communication opening 522. A detection board 54 is mounted in the communication opening 522 and has a longitudinal slot 543 (FIG. 4) in each lateral side thereof into which a side of a respective partitioning member 511, 521 is inserted. Thus, the detection board 54 may slide relative to the bill-collecting box 5 under the guidance of the partitioning members 511 and 521. A magnetic element 542 is mounted on an end of the detection board 54 and faces the magnetic element 551 on the circuit board 55. Further, a stop 541 is provided on an end face of the detection board 54 and extended into the first compartment 512 for receiving bills 7. An elastic element 552 is attached between the end face of the detection board 54 and the rear wall 50 of the bill-collecting box 5 such that the magnetic element 542 on the detection board 54 is initially aligned with the magnetic element 551 on the circuit board 55.

Figure 11:
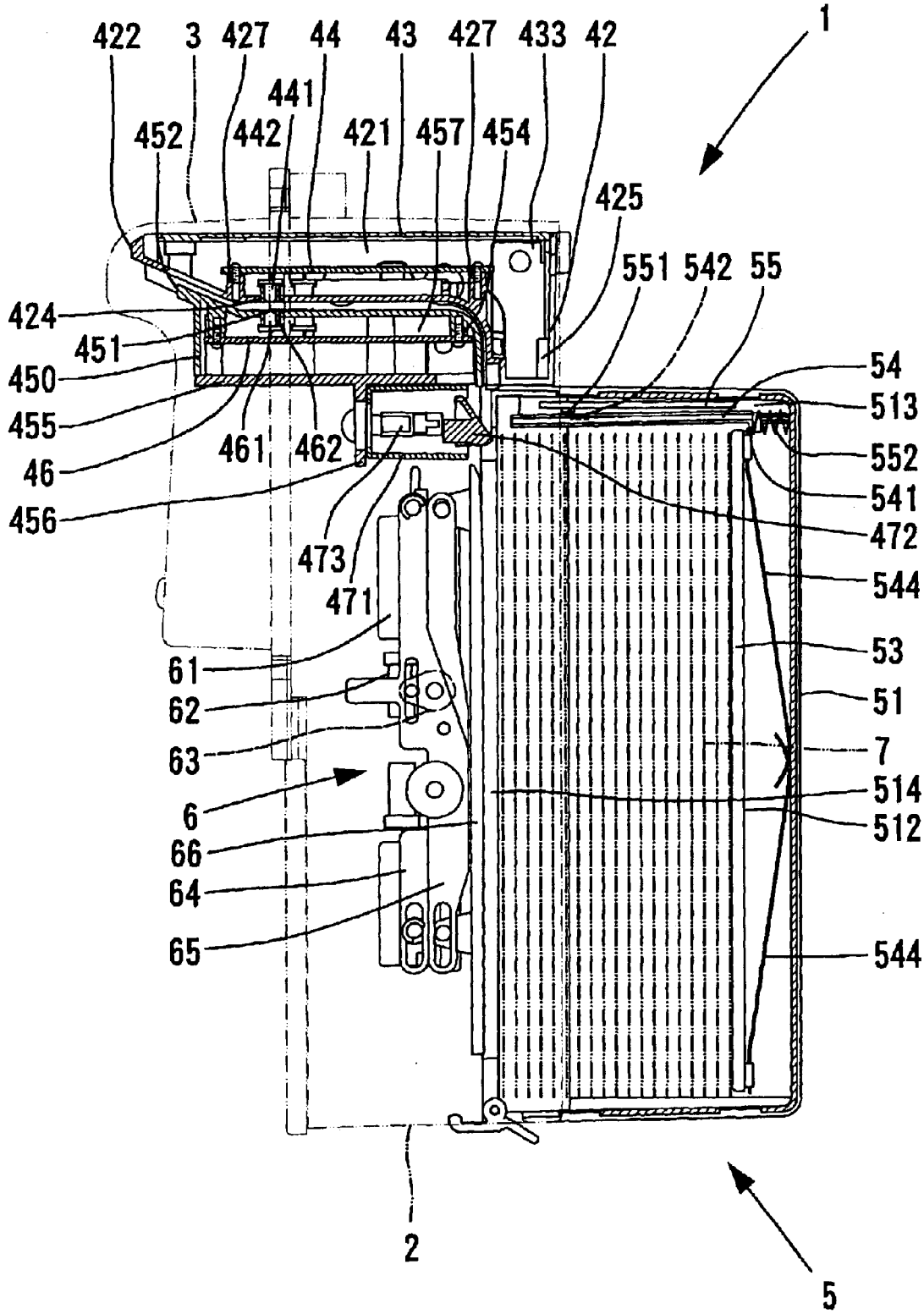
FIG. 11 is a view similar to FIG. 10, wherein the bill-collecting box is full.

Referring to FIG. 11, when the number of bills 7 in the first compartment 512 of the bill-collecting box 5 increases, the pressing plate 53 moves the resilient members 544 toward the rear wall 50 of the bill-collecting box 5. When the bills 7 in the first compartment 512 are in an amount sufficient to urge the pressing plate 53 to be in contact with the stop 541 on the detection board 54, the detection board 54 is moved toward the rear wall 50 of the bill-collecting box 5 when more bills 7 are received in the first compartment 512 until the magnetic element 542 on the detection board 54 is no longer aligned with the magnetic element 551 on the circuit board 55. This will cause the paper currency receiving apparatus to stop operation, as the first compartment 512 is full with bills 7.

Figure 12:
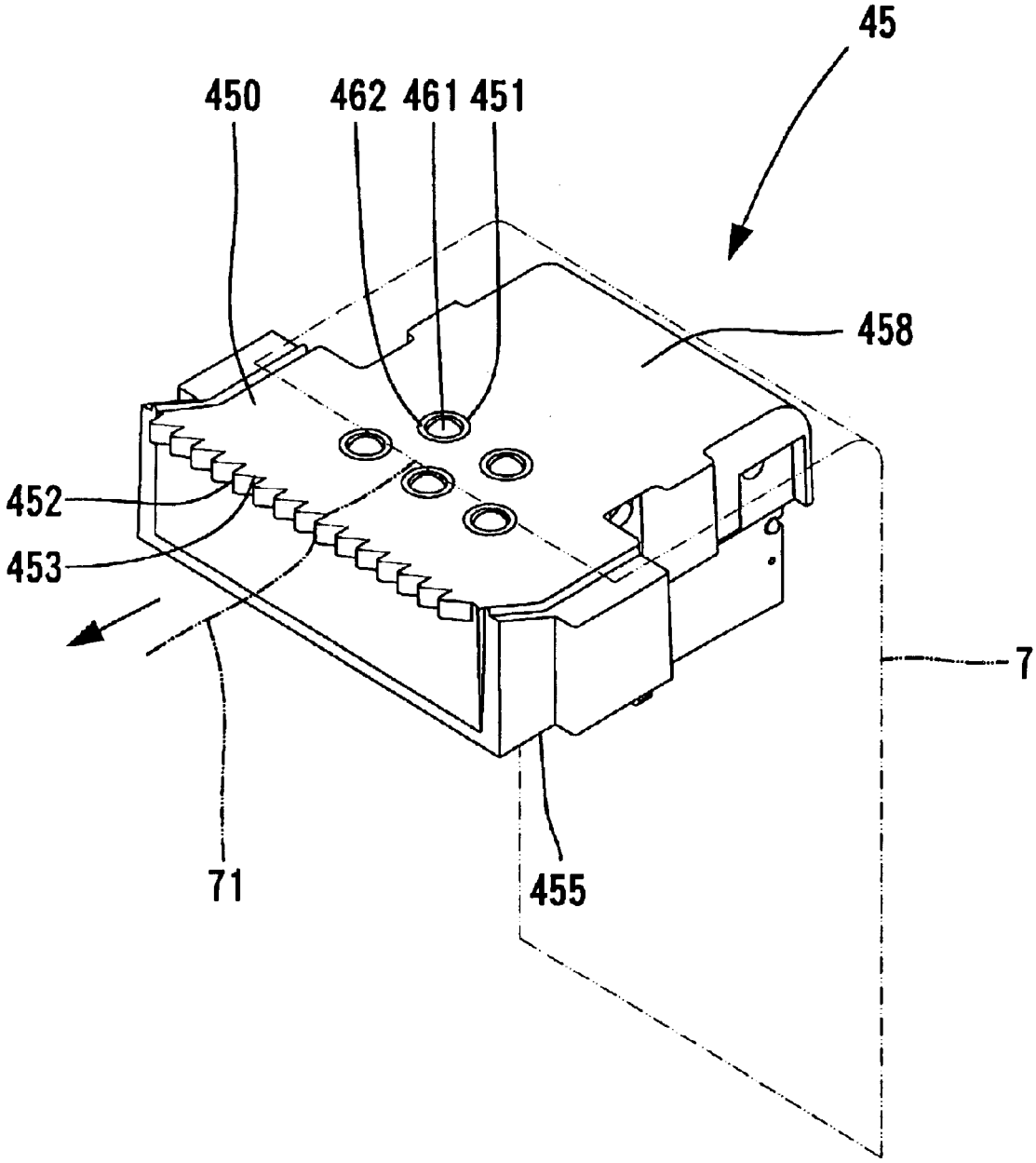
FIG. 12 is a perspective view illustrating prevention of fraud operation by the lower detection box of the first detecting device.

Prevention of fraud operation will now be described with reference to FIGS. 12 and 13. Since the toothed portion 452 of the lower detection box 45 of the first detection device 4 projects upward, when a bill 7 with an end of a string 71 bonded thereto is inserted into the body 2 via the bill-receiving opening 31 of the front cover 3, a portion of the string 71 dragged by the inwardly moving bill 7 falls down and is severed by one of the cutting edges 453 of the toothed portion 452 due to the level difference between the cutting edges 453 and a general plane of the top surface 458 of the lower detection box 45, best shown in FIG. 12. Thus, the string 71 is severed when the bill 7 is moving toward the second detection device 47. In a case that the fraud pulls the string 71 before the bill 7 completely passes the second detection device 47, the string 71 will be severed by one of the cutting edges 453.

Figure 13:
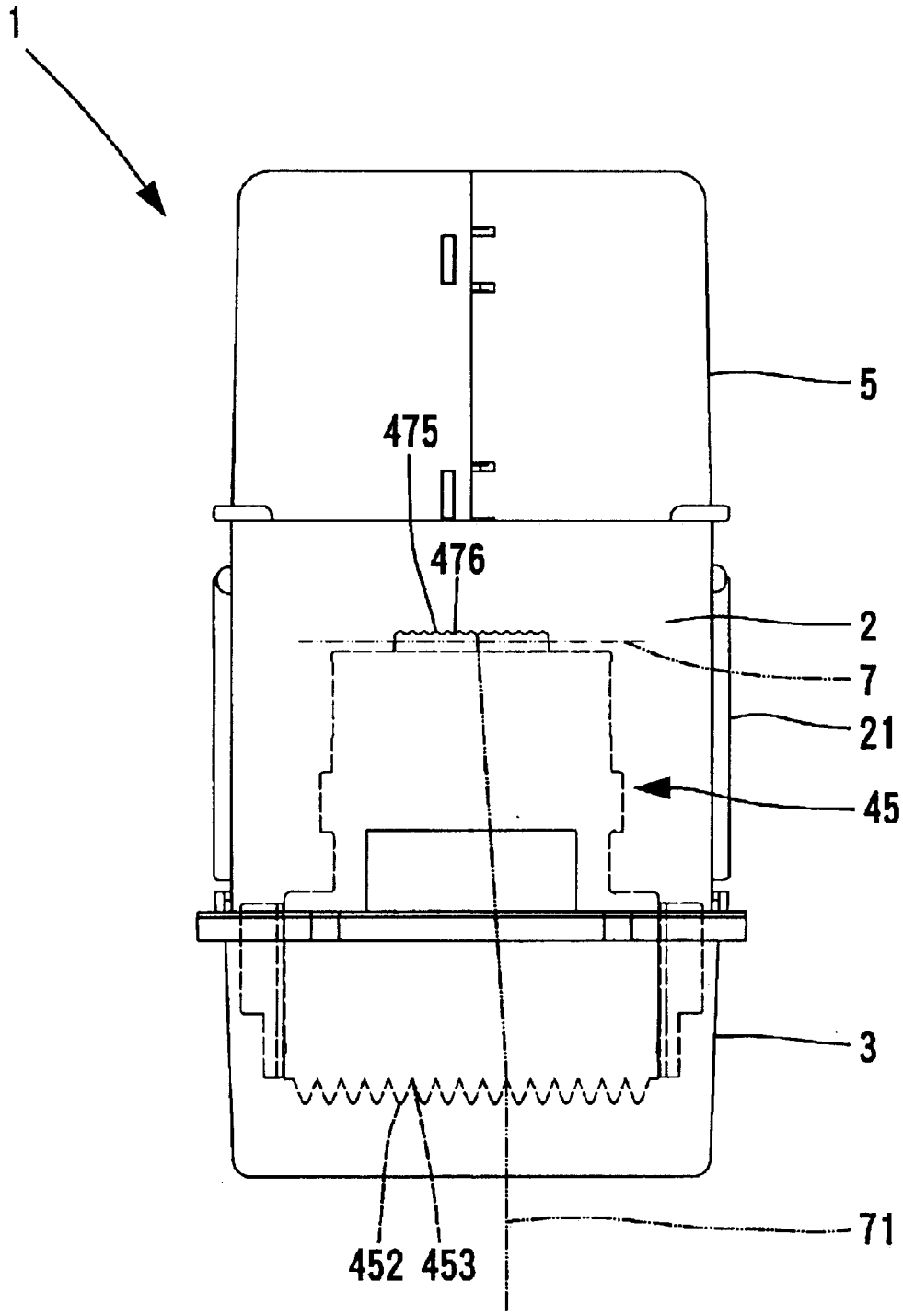
FIG. 13 is a view illustrating prevention of fraud operation by the detection box of the second detecting device of the paper currency receiving apparatus in accordance with the present invention.

In a case that the bill 7 has passed through the first detection device 4 and that the string 71 is not severed, the string 71 will be in contact with the one of the cutting edges 453 of the first detection device 4 and one of the cutting edges 476 of the second detection device 47 after the bill 7 has completely passed through the second detection device 47, as shown in FIG. 13. At this time, if the fraud is intended to pull the bill 7 outward by the string 71, the string 71 will be severed by at least one of one of the cutting edges 453 and one of the cutting edges 476. Thus, the chance of fraud operation by bonding an end of a string 71 to a side of a bill 7 is zero, and the risk of damage to the paper currency receiving apparatus resulting from fraud operation is largely reduced.

Although the invention has been explained in relation to its preferred embodiment, it is to be understood that many other possible modifications and variations can be made without departing from the scope of the invention as hereinafter claimed.

What is claimed is:

1. A paper currency receiving apparatus comprising:

a body having a bill-receiving opening in a front end thereof;

a first detecting device mounted in the body and defining a bill passage through which a bill inserted into the bill-receiving opening passes, the first detecting device discriminating genuineness of the bill;

means for feeding the bill inserted into the bill-receiving opening into an interior of the body;

means for severing a string attached to a side of the bill;

a bill-collecting box mounted to a rear of the body for receiving the bill fed into the interior of the body; and a second detecting device between the first detecting device and the bill-collecting box, the second detecting device detecting passage of the bill therethrough, the second detecting device including means for pushing the bill that has passed therethrough into the bill-collecting box.

2. The paper currency receiving apparatus as claimed in claim 1, wherein said second detecting device further includes means for severing a portion of the string that has passed through first-mentioned detecting device.

3. A paper currency receiving apparatus, comprising:

a body having a bill-receiving opening in a front end thereof;

a first detecting device mounted in the body and including an upper detection box and a lower detection box, the upper detection box and the lower detection box together defining a bill passage through which a bill inserted into the bill-receiving opening passes, the first detecting device discriminating genuineness of the bill, the lower detection box including a top surface having an end adjacent to the bill-receiving opening, a toothed portion being formed on the end of the top surface and projecting upward, with a cutting edge being defined between two adjacent teeth of the toothed portion of the lower detection box;

a second detecting device mounted below the lower detection box, the second detection device including a detection block pivotally mounted thereto, the detection block including a toothed portion, with a cutting edge being defined between two adjacent teeth of the toothed portion of the detection block; and means for feeding the bill inserted into the bill-receiving opening to the first detection device and the second detection device;

wherein when a fraud operation is proceeded by bonding an end of a string to a side of a bill and inserting the bill through the bill-receiving opening, the string falls into and is thus severed by one of the cutting edges of the first detection device when the string is pulled before the bill is completely passed through the second detection device or when the bill is moving toward the second detection device; and wherein when the bill is passed through the second detecting device without being severed by the cutting edges of the first detecting device, the string falls into one of the cutting edges of the first detecting device and one of the cutting edges of the second detecting device such that the string is severed when the string is pulled.

4. The paper currency receiving apparatus as claimed in claim 3, wherein the body includes two fixing holes respectively on two opposed lateral sides thereof, the upper detection box of the first detecting device having two opposed lateral sides each having an engaging portion, further including two engaging plate each having a protrusion extending through an associated one of the lateral sides of the upper detecting box into an associated one of the fixing holes of the body, thereby positioning the first detecting device.

5. The paper currency receiving apparatus as claimed in claim 3, wherein the upper detection box includes at least one detection hole in a bottom wall thereof, further including a circuit board mounted inside the upper detection box, the circuit board including at least one detecting element that is extended into said at least one detection hole of the upper detection box, further including at least one protective cover mounted to said at least one detecting element, each said protective cover being tightly mounted between an associated one of the detecting elements and a peripheral wall defining an associated one of the detection holes.

6. The paper currency receiving apparatus as claimed in claim 3, wherein the lower detection box includes at least one detection hole in a top surface thereof, further including a circuit board mounted inside the lower detection box, the circuit board including at least one detecting element that is extended into said at least one detection hole of the lower detection box, further including at least one protective cover mounted to said at least one detecting element, each said protective cover being tightly mounted between an associated one of the detecting elements and a peripheral wall defining an associated one of the detection holes.

7. The paper currency receiving apparatus as claimed in claim 3, further including a bill-collecting box mounted to a rear of the body, the bill-collecting box including a first compartment for receiving the bill that has passed through the second detecting device and a second compartment, the bill-collecting box including a bill-entrance opening delimited by a peripheral edge, the bill-entrance opening having an area smaller than that of the bill, a pressing plate being mounted in the first compartment and having an area greater than that of the bill-entrance opening, further including means for biasing the pressing plate to press against the peripheral edge delimiting the bill-entrance opening.

8. The paper currency receiving apparatus as claimed in claim 7, wherein the first compartment and the second compartment of the bill-collecting box are separated from each other by two partitioning members, further including a detection board slidably mounted between the partitioning members, with an elastic element being attached between the detection board and a rear wall of the bill-collecting box, a first magnetic element being mounted on the detection board, a circuit board being mounted in the second compartment and including a second magnetic element that is initially aligned with the first magnetic element, a signal indicating that the bill-collecting box is full is sent when the first magnetic element is not aligned with the second magnet element.

9. The paper currency receiving apparatus as claimed in claim 8, wherein the detection board includes a longitudinal groove in each of two lateral sides thereof, each said partitioning member including a side engaged in an associated one of the longitudinal grooves of the detection board, allowing sliding movement of the detection board relative to the partitioning members.

10. The paper currency receiving apparatus as claimed in claim 3, wherein the bill-collecting box includes two casing halves.

* * * * *